US009498092B2

(12) United States Patent
Chang

(10) Patent No.: US 9,498,092 B2
(45) Date of Patent: Nov. 22, 2016

(54) CLEANING BRUSH

(71) Applicant: Che-Yuan Chang, Changhua County (TW)

(72) Inventor: Che-Yuan Chang, Changhua County (TW)

( * ) Notice: Subject to any disclaimer, the term of this patent is extended or adjusted under 35 U.S.C. 154(b) by 494 days.

(21) Appl. No.: 14/049,812

(22) Filed: Oct. 9, 2013

(65) Prior Publication Data

US 2014/0033459 A1 Feb. 6, 2014

Related U.S. Application Data

(63) Continuation-in-part of application No. 13/232,468, filed on Sep. 14, 2011, now abandoned.

(30) Foreign Application Priority Data

May 31, 2011 (TW) ..... 100209818 U

(51) Int. Cl.

| | |
|---|---|
| ***A47K 7/02*** | (2006.01) |
| ***A46B 5/00*** | (2006.01) |
| ***A46B 9/00*** | (2006.01) |

(52) U.S. Cl.

CPC ..... *A47K 7/028* (2013.01); *A46B 5/0095* (2013.01); *A46B 9/005* (2013.01); *A46B 2200/30* (2013.01)

(58) Field of Classification Search

CPC ..... A47L 13/16; A47L 13/20; A47L 13/38; A47L 13/46; A47L 13/44; A47L 13/24; A47L 13/10; A47L 13/255; A47K 7/02; A47K 11/10; A47K 7/00; A47K 7/022; A47K 7/08; A46B 2200/3046; A46B 5/00; A46B 5/02; A46B 9/10

See application file for complete search history.

(56) References Cited

U.S. PATENT DOCUMENTS 6,453,503 B1 * 9/2002 Chen ..... A47K 7/028 15/209.1

6,677,027 B1 1/2004 Le

FOREIGN PATENT DOCUMENTS

| | | |
|---|---|---|
| TW | 216512 | 11/1993 |
| TW | 563512 | 2/2001 |

* cited by examiner

*Primary Examiner* — Robert Scruggs
(74) *Attorney, Agent, or Firm* — Muncy, Geissler, Olds & Lowe, P.C.

(57) ABSTRACT

A cleaning brush is composed of a grip, a brush body, and a tightener. The grip includes a mounting portion running through first and second lateral sides and having an opening formed on a top side thereof, and a retaining portion located at third and fourth lateral sides. The brush body is a spherical reticular member formed of a tubular reticulum and includes a central portion passing through the opening and located at the mounting portion. The holds the central portion and the retaining portion for limiting the relative positions of the brush body and the grip. Thus, the brush body is not subject to sliding with respect to the grip to make the cleaning brush have definite perception of touch and preferable cleaning effect.

2 Claims, 13 Drawing Sheets

CLEANING BRUSH

CROSS REFERENCE TO RELATED APPLICATIONS

The present application is a continuation-in-part of co-pending application Ser. No. 13/232,468, filed on Sep. 14, 2011, for which priority is claimed under 35 U.S.C. §120; and this application claims priority of Application No. 100209818, filed in Taiwan, R.O.C. on May 31, 2011 under 35 U.S.C. §119; the entire contents of which are hereby incorporated by reference.

BACKGROUND OF THE INVENTION

1. Field of the Invention

The present invention relates generally to a cleaning apparatus, and more particularly, to a cleaning brush.

2. Description of the Related Art

Referring to Taiwanese Utility Model No. 216512, it disclosed a cleaning brush composed of a grip and a spherical reticular brush. The spherical reticular brush is formed by way of folding an elongated tubular mesh, sleeving a band onto a center of the mesh, enabling the mesh to pass through an annulus of the grip to make the band be located in the annulus and two halves of the mesh to be located at two external sides of the grip, and finally pull the two halves of the mesh toward opposites directions separately for looseness thereof to make the mesh become spherical and prevent the mesh from easy separation from the grip.

Taiwan Patent No. 563512 disclosed a cleaning brush formed of a resilient reticular tube, a grip, and a rope-like tie. The resilient reticular tube includes a predetermined length and a predetermined thickness and is squeezed to make its peripheral edge curved continuously along its axis. The grip is mounted to an external side of the resilient reticular tube and includes an accommodation cavity and a plurality of fastening portions running through the sidewall of the accommodation cavity. The accommodation cavity includes an open end for a part of the resilient reticular tube to be received in the accommodation cavity. The rope-like tie surrounds the fastening portions and the resilient reticular tube with respect to the grip to suppress the blown-up resilient reticular tube to the grip.

However, when a user operates the aforesaid cleaning brush, the spherical reticular brush or the resilient reticular tube is subject to sliding along with the user's operation to result in indefinite feeling of touch while the user brushes their bodies to further reduce the cleaning effect. In other words, the aforesaid conventional cleaning brush is still deficient to need further improvement.

SUMMARY OF THE INVENTION

The primary objective of the present invention is to provide a cleaning brush, which enables the user to have definite feeling of touch while brushing his or her body.

The foregoing objective of the present invention is attained by the cleaning brush composed of a grip, a brush member, and a tightener. The grip includes a first axial direction and a second axial direction horizontally; the first and second axial directions cross each other. The grip further includes a first lateral side located at the first axial direction, a second lateral side opposite to the first lateral side, a top side, and a mounting portion running through the first and second lateral sides, and a retaining portion. The mounting portion includes an opening formed on the top side. The grip includes a third lateral side and a fourth lateral side at the second axial direction; the first and second lateral sides are opposite to each other. The retaining portion is located on the third and fourth lateral sides.

The brush body is a spherical reticular member formed of a tubular reticulum and includes a first brush portion, a second brush portion, and a central portion connected between the first and second brush portions. The central portion passes through the opening and is mounted to the mounting portion of the grip. The first and second brush portions are located at the first and second lateral sides of the grip separately.

The tightener holds the retaining portion of the grip and the central portion of the brush body tight for limiting the relative positions of the brush body and the grip.

Preferably, the retaining portion includes two channels communicating with the mounting portion and the tightener passes through each of the channels.

Preferably, each of the channels is elliptical.

Preferably, the retaining portion includes a through hole parallel to each of the channels and the tightener is inserted into the through hole.

Preferably, the retaining portion includes two elongated grooves recessed toward the mounting portion from the third and fourth lateral sides. The tightener is received in each of the elongated grooves.

Preferably, the mounting portion includes a cavity formed at each of two ends thereof and recessed inwards from each of the third and fourth lateral sides. Each of the cavities communicates with each elongated groove. The tightener is a cable tie and includes a head portion and a body portion. The head portion is received inside one of the cavities and the body portion is inserted through each of the channels and the through hole to be received inside the elongated grooves.

In light of above, the brush body is not subject to sliding with respect to the grip, so the cleaning brush of the present invention has definite touch perception for the user while it is in use and has preferable cleaning effect.

DETAILED DESCRIPTION OF PREFERRED EMBODIMENTS

Figure 1:
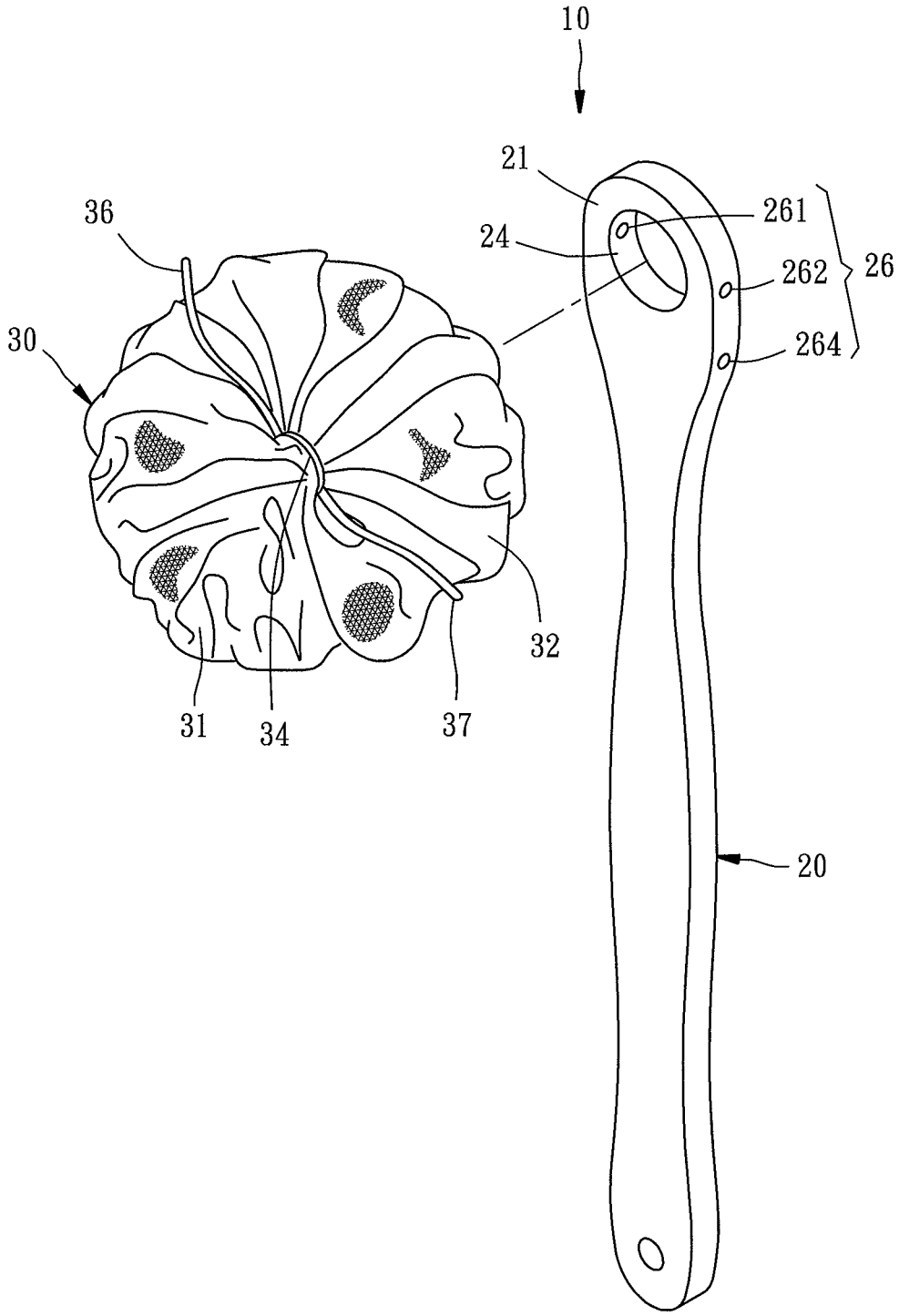
FIG. 1 is an exploded view of a first preferred embodiment of the present invention.
Figure 2:
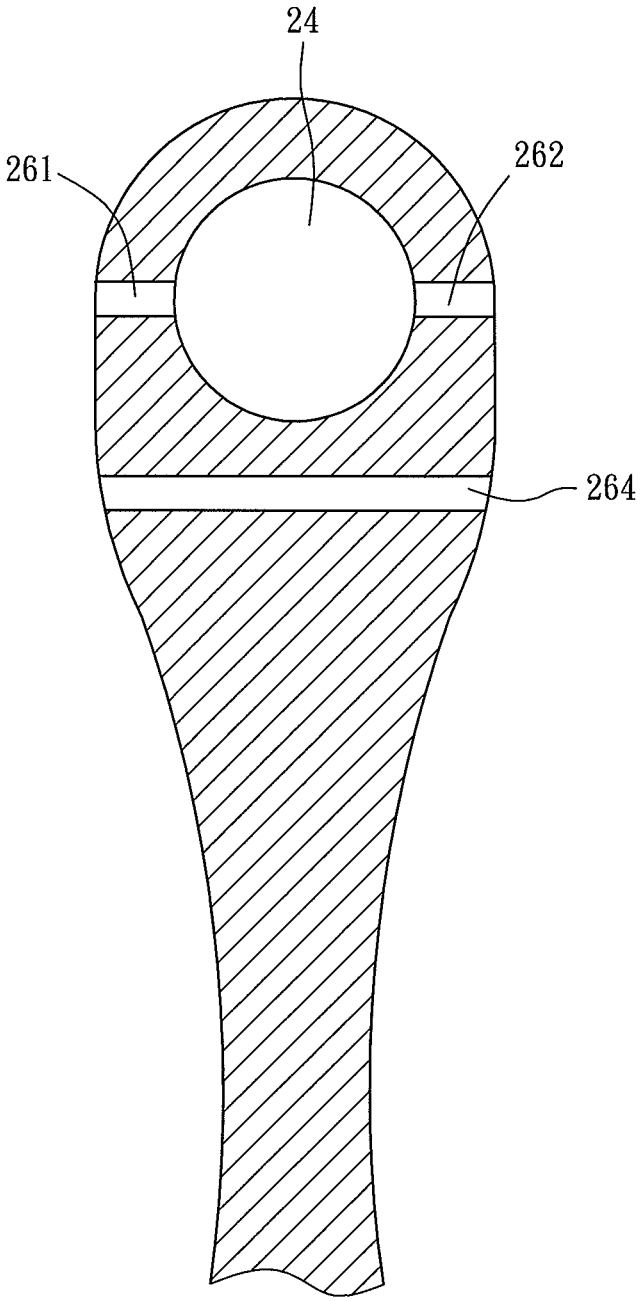
FIG. 2 is a sectional view of the grip of the first preferred embodiment of the present invention.
Figure 3:
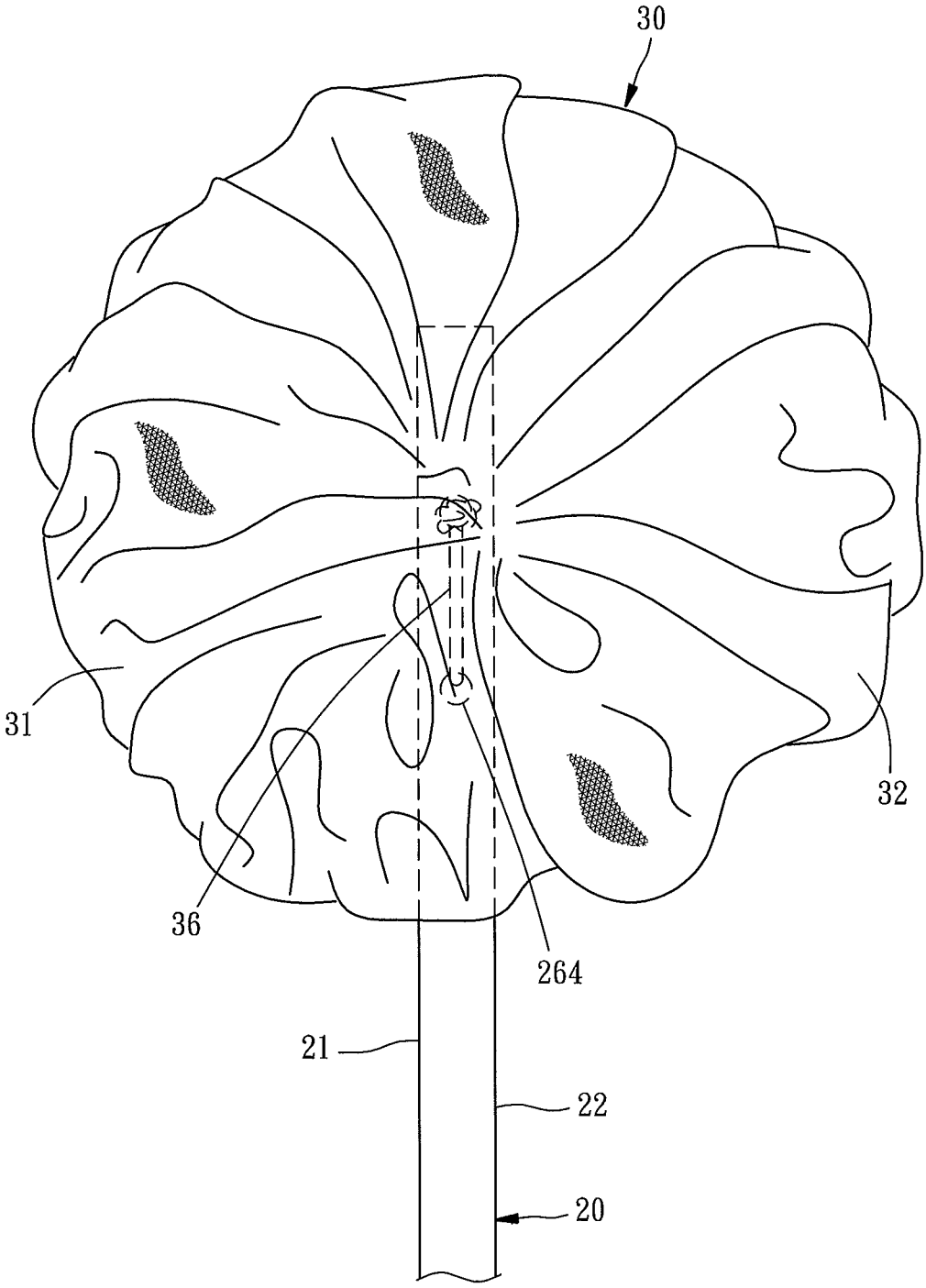
FIG. 3 is a side view of the first preferred embodiment of the present invention.

Referring to FIGS. 1-3, a cleaning brush 10 constructed according to a first preferred embodiment of the present invention is composed of a grip 20 and a brush body 30. The detailed descriptions and operations of these elements as well as their interrelations are recited in the respective paragraphs as follows.

The grip 20 includes a first lateral side 21, a second lateral side 22 opposite to the first lateral side 21, a mounting portion 24 located at one end portion of the grip 20 and running through the first and second lateral sides 21 and 22, and a retaining portion 26 adjacent to the mounting portion 24. In this embodiment, the retaining portion 26 has a first channel 261, a second channel 262, and a through hole 264 parallel to the first and second channels 261 and 262. The first and second channels 261 and 262 extend toward the mounting portion 24 from two opposite ends of the grip 20 and communicate with the mounting portion 24.

The brush body 30 is identical to the conventional spherical reticular brush in material, structure, and method of formation. The brush body 30 is formed of an elongated tubular reticular member, which is creased and then centrally tied, and mounted to the mounting portion 24, having a first brush portion 31 located at the first lateral side 21, a second brush portion 32 located at the second lateral side 22, and a central portion 34 connected between the first and second brush portions 31 and 32 and located inside the mounting portion 24. The brush body 30 further includes a first fastening string 36 and a second fastening string 37, both of which extend outward from the central portion 34, for connection with the retaining portion 24 in such a way that the more secure connection is available for confining the relative positions of the central portion 34 and the grip 20 to prevent them from easy movement with respect to each other.

In this embodiment, the central portion 34 and the fastening strings 36 and 37 are made of the same rope and the fastening strings 36 and 37 are two distal ends of the rope. Alternatively, the central portion 34 can be formed of another rope or a nylon band. The first and second fastening strips 36 and 37 pass through the first and second channels 261 and 262 from the retaining portion 24, as shown in FIG. 3, and then pass through the through hole 264; next, the first and second fastening strips 36 and 37 can be knotted each other to be fixed to the opening of the second channel 262. However, various interchangeable equivalents can replace how the first and second fastening strips 36 and 37 pass through the through hole 264 and what the first and second fastening strips 36 and 37 are knotted each other to be fixed to the grip 20. Even the grip 20 can have none of the through hole 264 but the two fastening strings 36 and 37 can still be knotted each other or knotted to the opening between the two channels 261 and 262.

Figure 4:
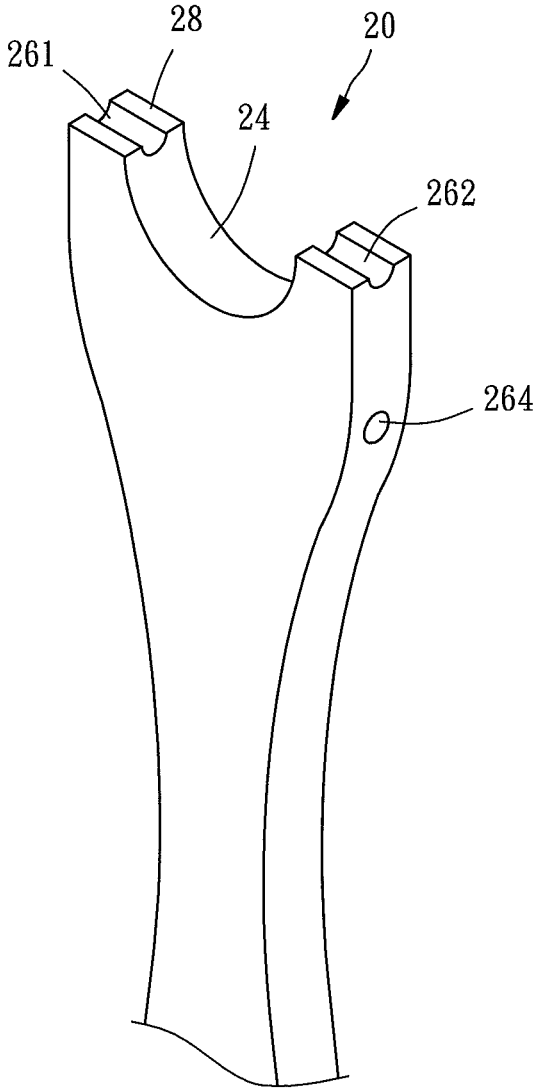
FIG. 4 is a perspective view of a second preferred embodiment of the present invention.
Figure 5:
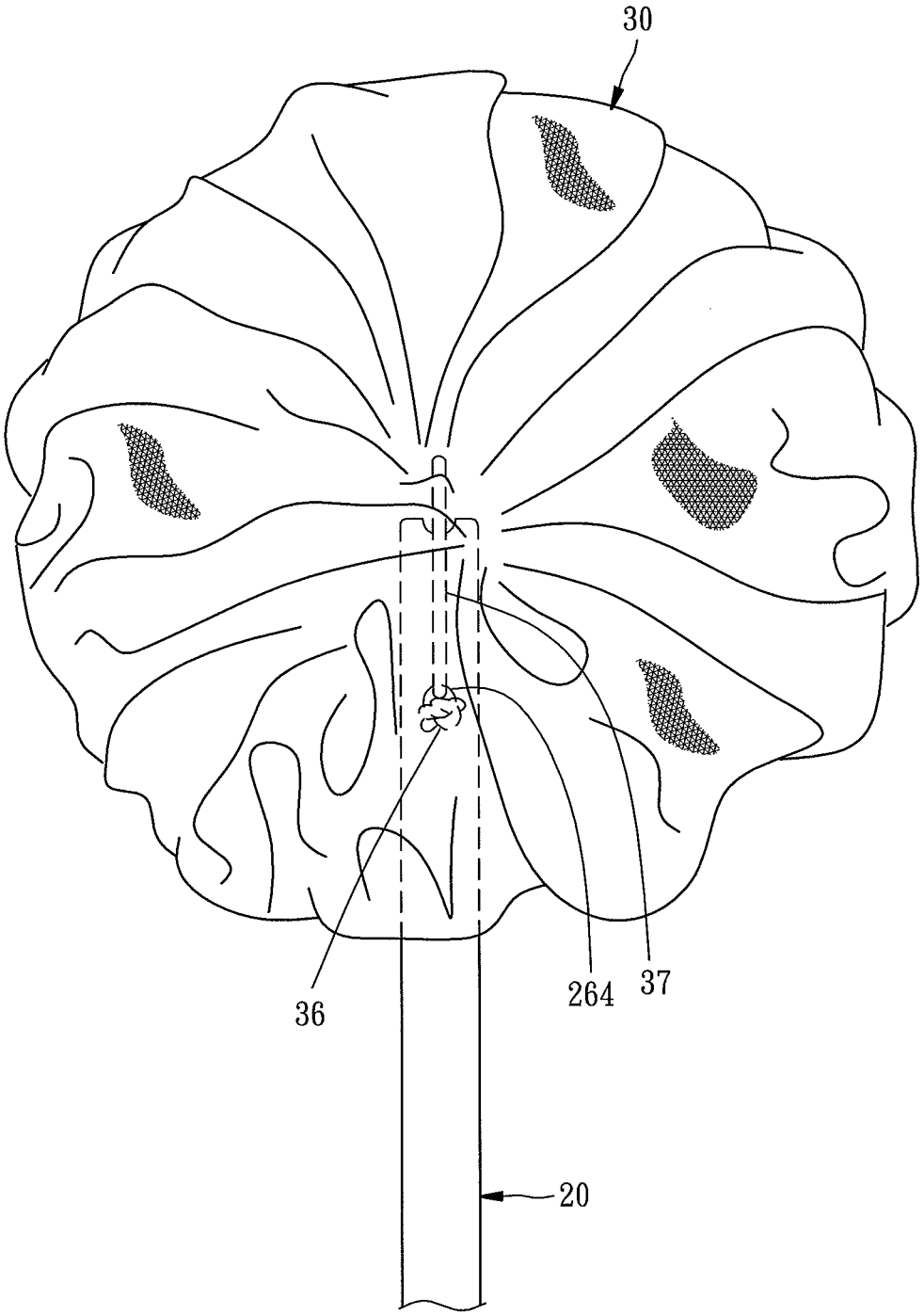
FIG. 5 is a side view of the second preferred embodiment of the present invention.

It is to be noted that the mounting portion 24 of the grip 20 of the aforesaid embodiment is shaped as, but not limited to, a sealed circle, and even the mounting portion 24 can be open. For example, the mounting portion 24 of the grip 20 shown in FIG. 4 is recessed downward from a top side 28 in such a way that the two fastening strips 36 and 37 can pass through the two channels 261 and 262 separately and then the through hole 264 and finally be knotted at openings of two ends of the through hole 264 to be fixed to the grip 20, as shown in FIG. 5.

Figure 6:
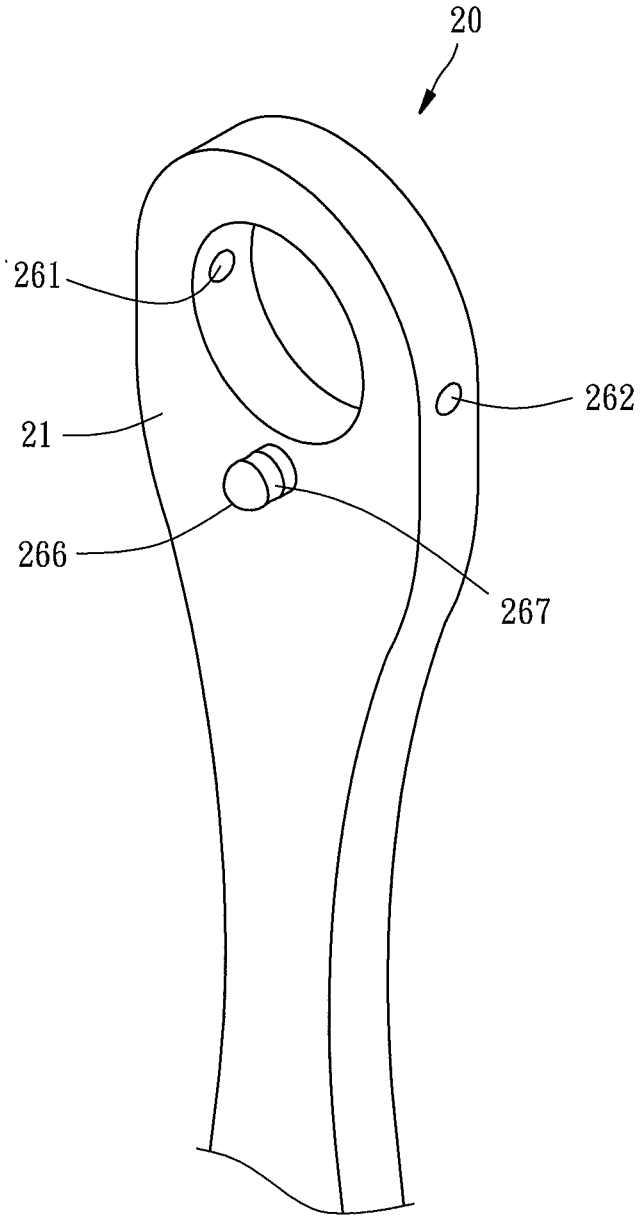
FIG. 6 is a perspective view of a third preferred embodiment of the present invention.
Figure 7:
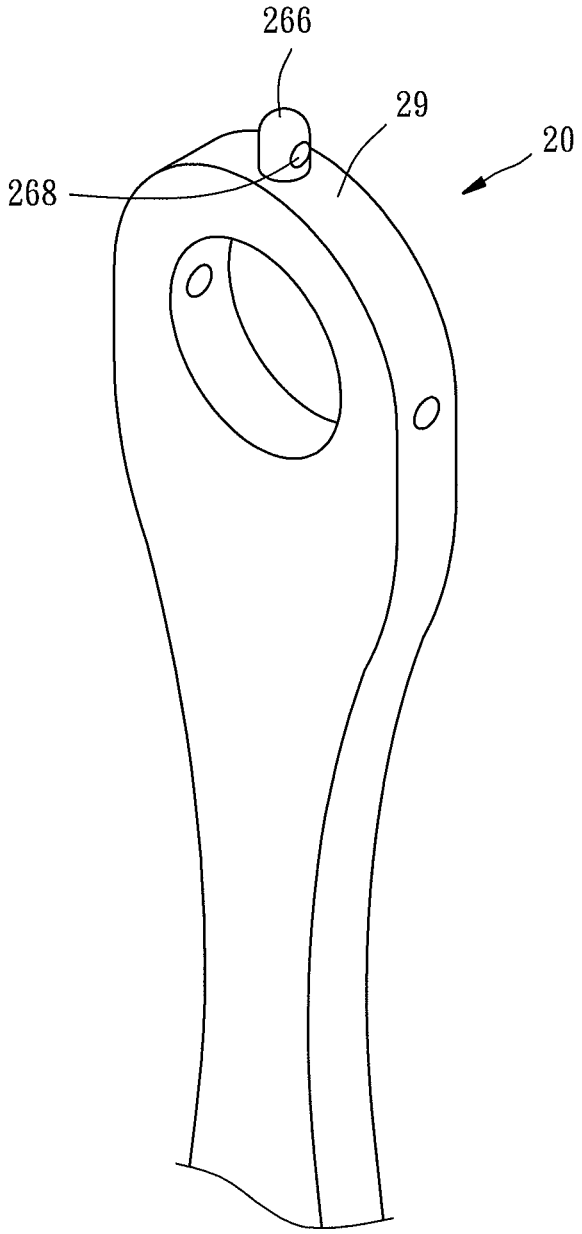
FIG. 7 is a perspective view of a fourth preferred embodiment of the present invention.

Referring to FIG. 6, the through hole 264 in the first embodiment can be interchanged by a post 266 protruding outward from the first lateral side 21 in such a way that the fastening strings 36 and 37 can pass through the two channels 261 and 262 and then be wound around the post 266 to be fixed to the grip 20. As shown in FIG. 7, the post 266 can protrude outward from a top side 29 of the grip 20 to reach the same effect. Besides, the post 266 can have an annular groove 267 (FIG. 6) or a through hole 268 (FIG. 7) for the fastening strips 36 and 37 to be wound around or to pass through to be more easily fixed to the post 266.

Figure 8:
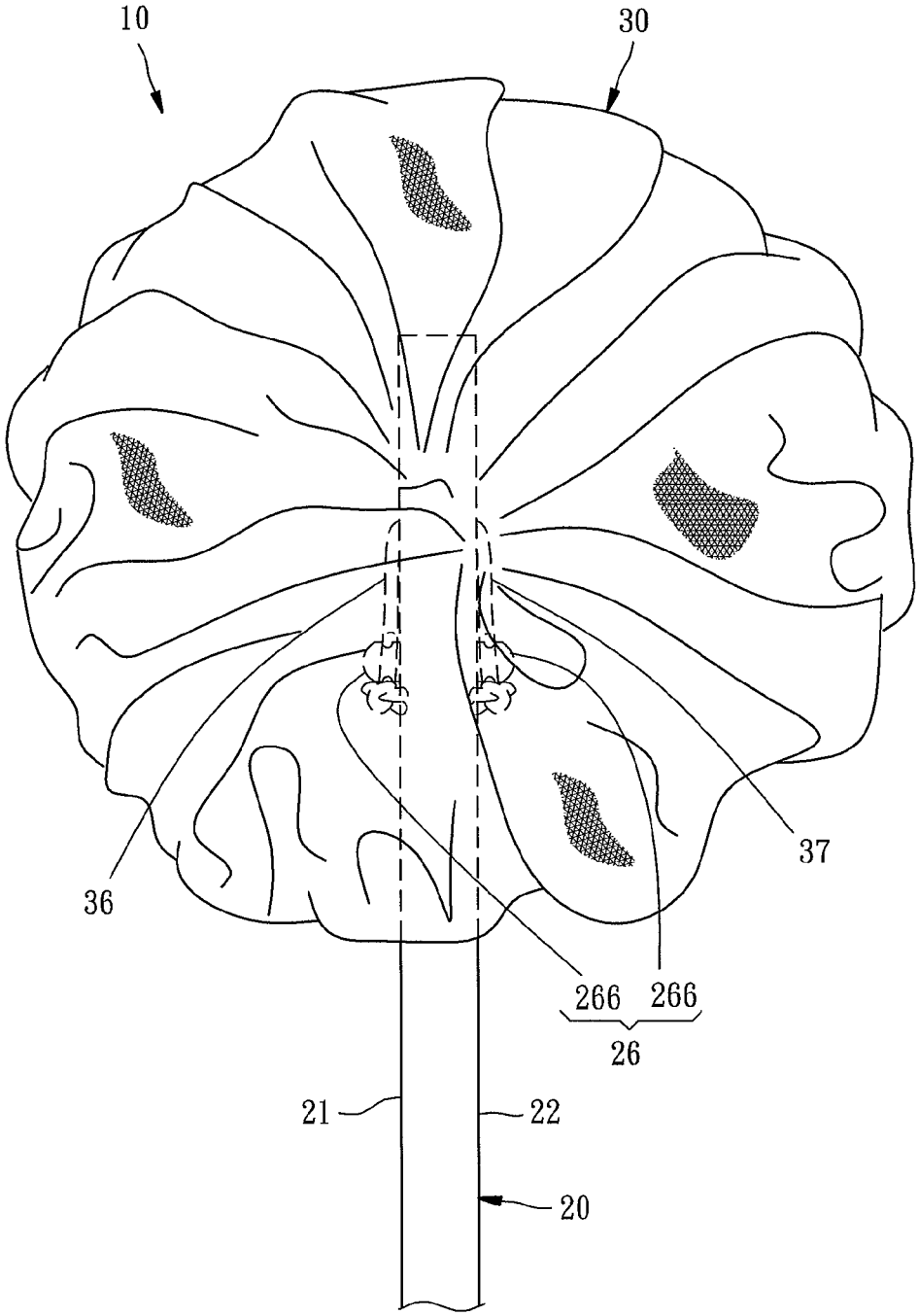
FIG. 8 is a side view of a fifth preferred embodiment of the present invention.

Referring to FIG. 8, the retaining portion 26 can further include two posts 266 protruding outward from the first and second lateral sides 21 and 22 in such a way that the fastening strips 36 and 37 can pass through the two openings of the mounting portion 24 and be wound around the two posts 266 separately.

Figure 9:
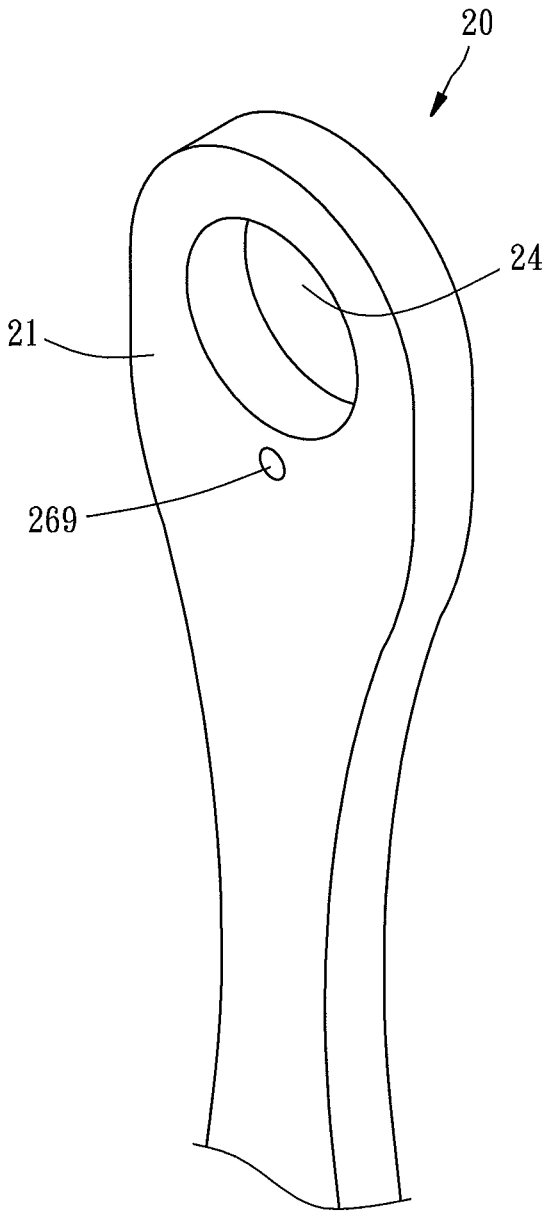
FIG. 9 is a perspective view of the grip of a sixth preferred embodiment of the present invention.
Figure 10:
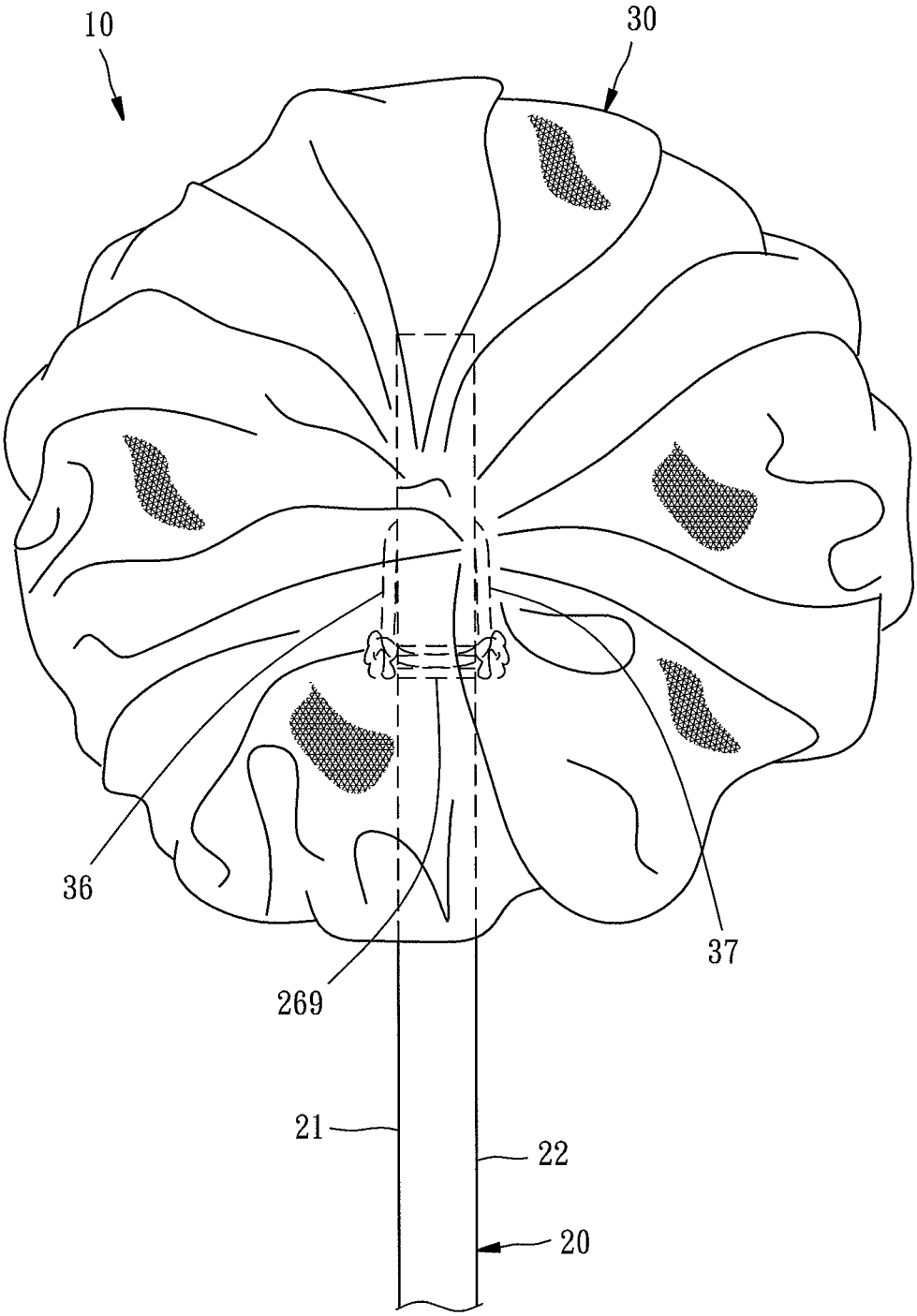
FIG. 10 is a side view of the sixth preferred embodiment of the present invention.

Referring to FIGS. 9 and 10, the retaining portion 26 can further includes a through hole 269 running through the first and second lateral sides 21 and 22 in such a way that the fastening strips 36 and 37 can pass through the through hole 269, after extending out of the openings of the mounting portion 24, and be knotted at two openings of the through hole 269 to be fixed to the grip 20. Alternatively, one of the two fastening strips 36 and 37 passes through the through hole 269 and then the two fastening strips 36 and 37 are knitted each other.

In the aforesaid embodiments, the way that the two fastening strips 36 and 37 are knotted to be fixed to the grip 20 is interchangeable and not limited to itself. In fact, the feature of the present invention lies in that the brush body 30 includes at least one fastening strip which can be mounted to the retaining portion 26 to be fixed to the grip 20 to prevent the brush body 30 from easy sliding with respect to the grip 20. In this way, while operating the cleaning brush 10, the user can have more definite feeling of touch and the cleaning effect can be better than the prior art.

Figure 11:
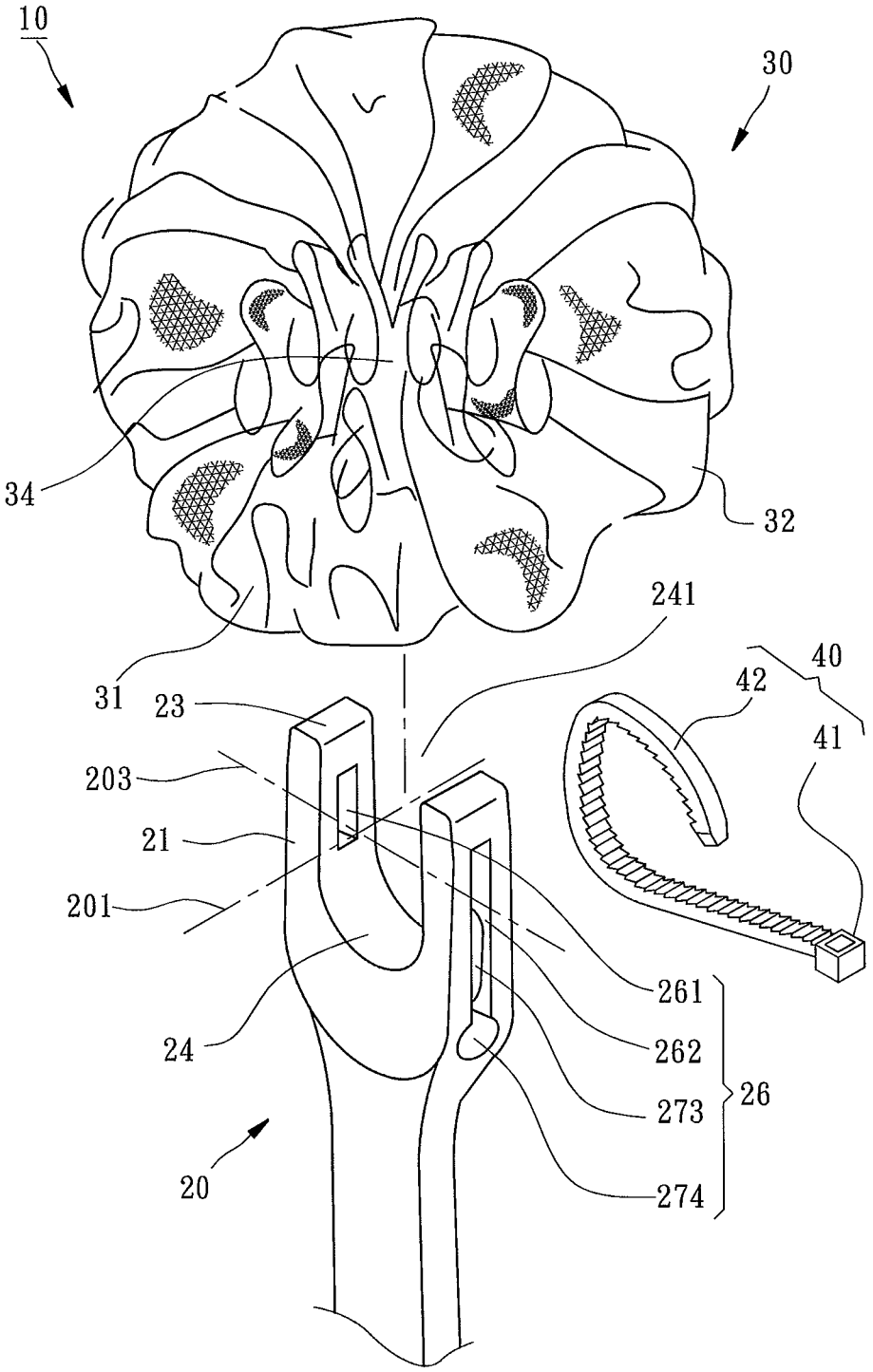
FIG. 11 is an exploded view of a seventh preferred embodiment of the present invention.
Figure 12:
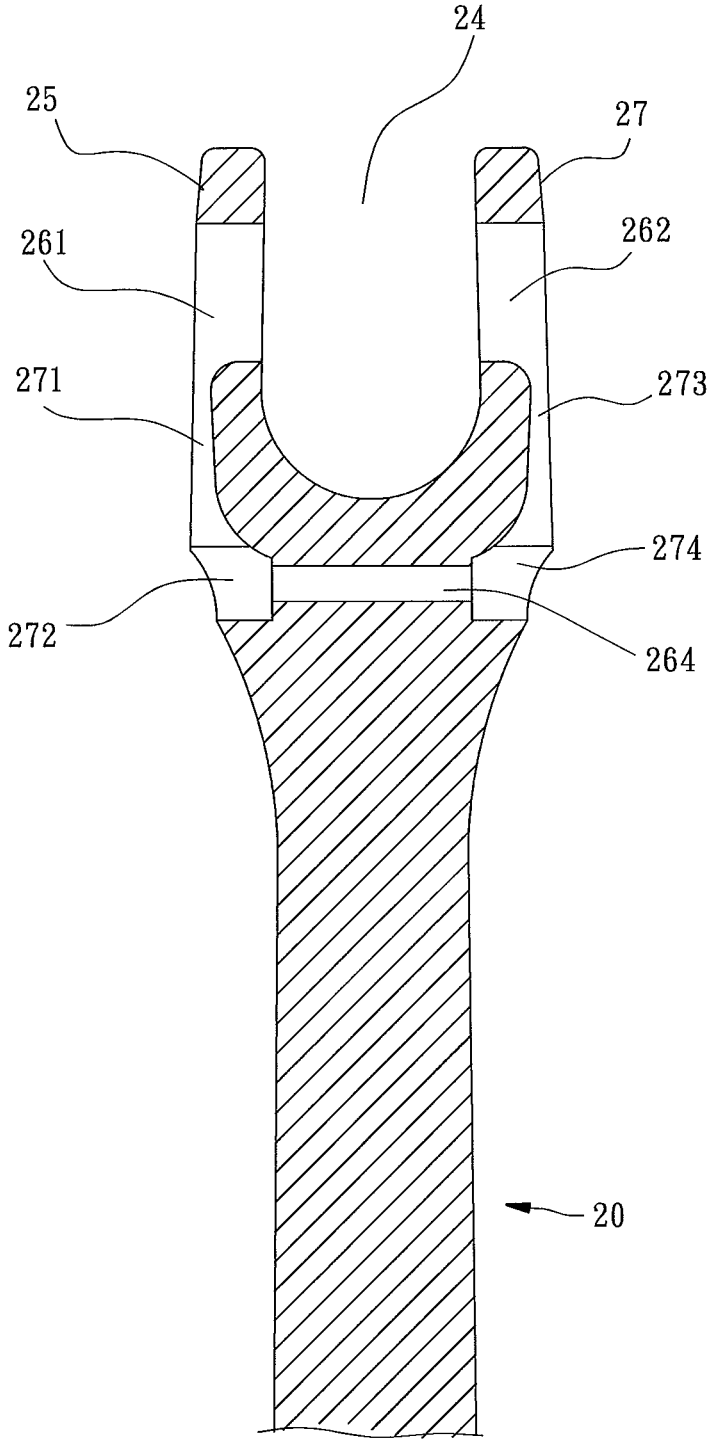
FIG. 12 is a sectional view of the seventh preferred embodiment of the present invention.
Figure 13:
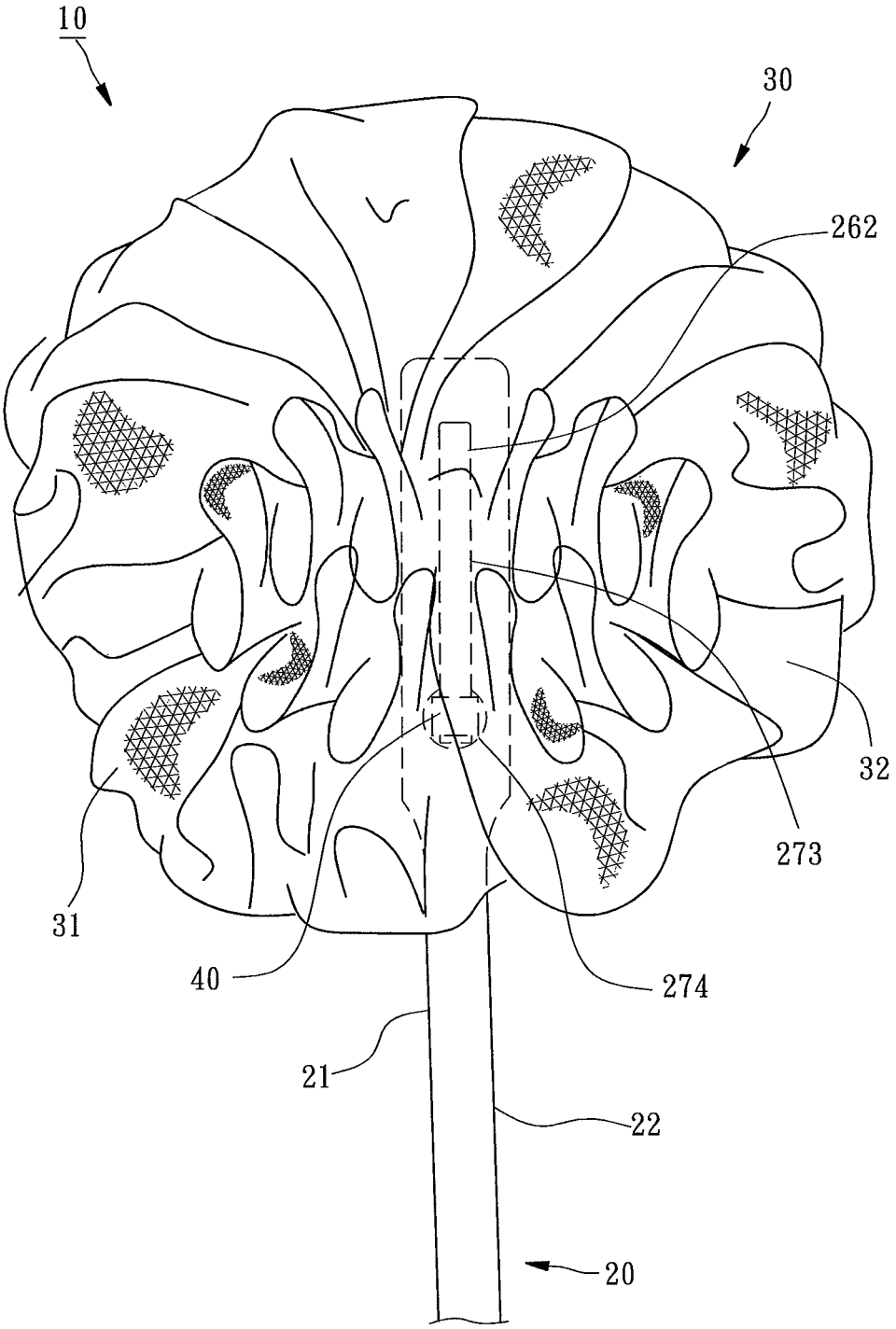
FIG. 13 is a side view of the seventh preferred embodiment of the present invention.

Referring to FIGS. 11-13, a cleaning brush 10 constructed according to a seventh preferred embodiment of the present invention is formed of a grip 20, a brush body 30, and a tightener 40.

The grip 20 includes a first axial direction and a second axial direction horizontally; the first and second axial directions cross each other. The grip 20 further includes a first lateral side 21, a second lateral side 22 opposite to the first lateral side 21, a top side 23, and a mounting portion 24 running through the first and second lateral sides 21 and 22 at the first axial direction 201. The mounting portion 24 includes an opening 241 on the top side 23. The grip 20 further includes a third lateral side 25, a fourth lateral side 27 opposite to the third lateral side 25, and a retaining portion at the second axial direction 203.

What the brush body 30 is made of, what structure the brush body 30 is, and how the brush body 30 is formed are similar to those of spherical reticular brush of the conventional cleaning brush. Basically, the brush body 30 is formed of an elongated tubular reticulum which is collapsed and then the center of which is bound. The brush body 30 includes a first brush portion 31, a second brush portion 32, and a central portion 34 connected between the first and second brush portions 31 and 32. The central portion 34 passes through the opening 241 to be located at the mounting portion 24. The first and second brush portions 31 and 32 are located on the first and second lateral sides 21 and 22 separately.

The tightener 40 holds the central portion 34 and the retaining portion 26 tight for limiting the relative position of the brush body 30 and the grip 20.

Specifically, referring to FIGS. 12 and 13 again, the retaining portion 26 includes a first channel 261, a second channel 262, a through hole 264, a first elongated groove 271, and a second elongated groove 273. The first and second channels 261 and 262 communicate with the mounting portion 24. The through hole 264 and the first and second channels 261 and 262 are arranged horizontally. The first and second elongated grooves 271 and 273 are recessed toward the mounting portion 24 from the third and fourth lateral sides 25 and 27. The through hole 264 includes a first cavity 272 and a second cavity 274, the former of which is recessed inwards from the third lateral side 25 and the latter of which is recessed inwards from the fourth lateral side 27. The first and second cavities 272 and 274 communicate with the first and second elongated grooves 271 and 273. In this preferred embodiment, the tightener 40 is a cable tie having a head portion 41 and a body portion 42. The head portion 41 can be received in the first or second cavity 272 or 274. The body portion 42 is inserted through the first and second channels 261 and 262 and the through hole 264 to be received in the first and second elongated grooves 271 and 273. In actual assembly, the body portion 42 of the tightener 40 passes through the through hole 264 from one end to the other end, through the first channel 261 along the first elongated groove 271, through the mounting portion 24 and squeezes the central portion 34 of the brush body 30, through the second channel 262, and is then engaged with the head portion 41 of the tightener 40 along the second elongated groove 273; finally the head portion 41 is received in the second cavity 274. In other words, the head portion 41 and the body portion 42 can be stably received in the first and second elongated grooves 271 and 273 and the first and second cavities 272 and 274 separately and in this way, the tightener 40 can be prevented from disengagement from the grip 20 to further prevent the brush body 30 from sliding or downfall. In light of this, the cleaning brush 10 makes the user feel more definitely while touching it and leads to better cleaning effect than the prior art. In addition, each of the first and second channels 261 and 262 in this preferred embodiment has such a shape that the brush body 30 is movable upward or downward along the first and second channels 261 and 262 when the brush body 30 become larger or smaller. In this way, the grip 20 can work with the brush body 30 of the variable size to further decrease the cost.

In conclusion, the present invention is characterized in that the tightener 40 can be fastened with the grip 20 via the retaining portion 26 to prevent the brush body 30 from easy sliding from the grip 20, so the cleaning brush 10 makes the user perceive the touch of the same more definitely and has better cleaning effect than the prior art.

Last but not the least, the present invention though has been described with respect to specific preferred embodiments thereof, but it is in no way limited to the specifics of the illustrated structures but changes and modifications may be made within the scope of the appended claims.

What is claimed is:

1. A cleaning brush comprising:

a grip having a first axial direction and a second axial direction horizontally, the grip having a first lateral side, a second lateral side, a top side and a mounting portion at the first axial direction, the first and second axial directions located horizontally and crossing each other, the first and second lateral sides being opposite to each other, the mounting portion running through the first and second lateral sides and having an opening formed on the top side, the grip having a third lateral side and a fourth lateral side opposite to the second axial direction, and a retaining portion being located at the third and fourth lateral sides;

a brush body formed of a tubular reticulum and having a first brush portion, a second brush portion, and a central portion connected between the first and second brush portions, the central portion passing through the opening to be located in the mounting portion, the first and second brush portions being located at the first and second lateral sides, respectively;

a tightener being holds the central portion and the retaining portion tight for limiting the relative positions of the brush body and the grip;

wherein the retaining portion comprises two channels communicating with the mounting portion, and the tightener through each of the two channels;

wherein the retaining portion further comprises a through hole parallel to each of the two channels; the tightener is inserted into the through hole;

wherein the retaining portion further comprises two elongated grooves recessed toward the mounting portion from the third and fourth lateral sides, respectively; the tightener is received in each of the elongated grooves;

wherein the through hole of the grip comprises two cavities formed at two ends thereof and recessed inwards from the third and fourth lateral sides, respectively; the tightener is a cable tie having a head portion and a body portion, the head portion being received in one of the cavities, the body portion being inserted into the two channels and the through holes and received in the elongated grooves.

2. The cleaning brush as defined in claim 1, wherein each of the two channels comprises such a shape that the tightener is movable along the two channels.

* * * * *